United States Patent [19]

Kimura et al.

[11] 3,937,630

[45] Feb. 10, 1976

[54] METHOD FOR PRODUCING IRON-BASE SINTERED ALLOYS WITH HIGH DENSITY

[75] Inventors: Takashi Kimura; Azusa Majima; Hiroshi Hamamoto, all of Nagoya, Japan

[73] Assignee: Kabushiki Kaisha Toyota Chuo Kenkyusho, Nagoya, Japan

[22] Filed: June 11, 1973

[21] Appl. No.: 369,123

Related U.S. Application Data

[63] Continuation-in-part of Ser. No. 142,556, May 12, 1971, abandoned.

[30] Foreign Application Priority Data

May 12, 1970 Japan ..... 45-40820

[52] U.S. Cl. ..... 75/200; 29/182

[51] Int. Cl.[2] ..... B22F 1/00

[58] Field of Search ..... 75/226, 200; 29/182

[56] References Cited

UNITED STATES PATENTS

| | | | |
|---|---|---|---|
| 2,226,520 | 12/1940 | Lenel | 75/200 |
| 2,238,382 | 4/1941 | Boegehold | 75/200 |
| 2,291,734 | 8/1942 | Lenel | 75/200 |
| 2,489,838 | 11/1949 | Webb | 75/200 |
| 3,144,330 | 8/1964 | Storchheim | 75/200 |
| 3,379,524 | 4/1968 | Koppius | 75/226 |

OTHER PUBLICATIONS

Brackpool et al. "Powder Metallurgy" Vol. 7 No. 14 1964 pp. 213–225.

Evans et al. "Powder Metallurgy" Vol. 7 No. 13 1964 pp. 50–63.

Calow et al. "Powder Metallurgy" Vol. 8 No. 15 1964 pp. 1–19.

*Primary Examiner*—Benjamin R. Padgett
*Assistant Examiner*—B. H. Hunt
*Attorney, Agent, or Firm*—Oblon, Fisher, Spivak, McClelland & Maier

[57] ABSTRACT

Iron-base sintered alloys, characterized by high density and good hardness, have been prepared by sintering an iron-base particulate material at a temperature within the range at which an alloy consisting of said particulate material will form a solid-liquid phase.

7 Claims, 7 Drawing Figures

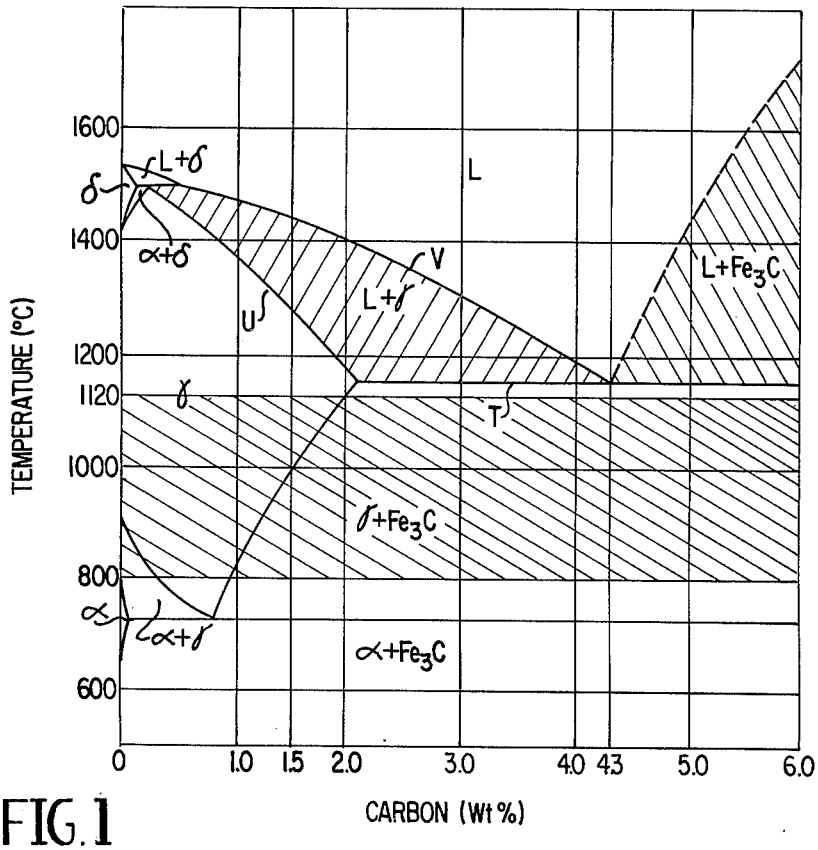
FIG. 1
FIG. 7
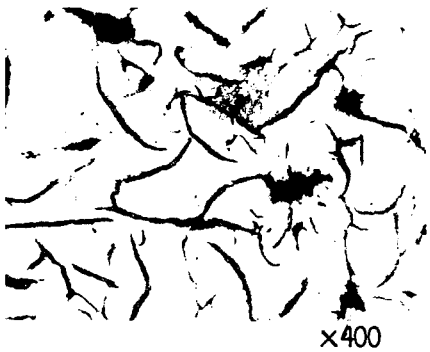
INVENTORS
TAKASHI KIMURA
AZUSA MAJIMA
HIROSHI HAMAMOTO
BY Oblon, Fisher & Spivak
ATTORNEYS

METHOD FOR PRODUCING IRON-BASE SINTERED ALLOYS WITH HIGH DENSITY

RELATIONSHIP TO PARENT APPLICATION

This is a continuation-in-part application of U.S. patent application Ser. No. 142,556, filed May 12, 1971, for "Method For Producing Iron-Base Sintered Alloys With High Density", now abandoned.

BACKGROUND OF THE INVENTION

1. Field Of The Invention

This invention relates to a method of producing sintered alloys and more particularly to a method of producing high density sintered alloys whereby the alloy component powder is sintered at a temperature within the range in which a solid phase and a liquid phase of the iron-base alloy coexist.

2. Description Of Prior Art

Although sintered iron alloys have been employed for various industrial parts, they have generally not found full acceptance for a wider scope of applications, primarily because they demonstrate inferior hardness and inferior density properties, as compared with similar alloys obtained by melt formation. The difficulty with conventional sintered alloys seems to be that during the sintering process, voids are formed between the solid alloy particles which have been subjected to the sintering temperatures and thereby considerably reduces the product density and weakens the product structure. This limits the possible fields of use of conventional sintered iron-base alloys to those areas permitting such low density, low hardness characteristics.

In view of increased industrial demands, however, for a sintered high density, high hardness iron base alloy, considerable efforts have been directed toward developing new processes and new techniques for producing such improved sintered products.

One such method developed has been to press the alloy powder during the sintering operation. Another method is to forge the sintered material at a high temperature. Neither of these methods, however, have found full acceptance in the art, since each require a strong mold and large pressing equipment capable of applying pressures of from a few hundred kgs/cm$^2$ to several tons/cm$^2$. The availability of this type of equipment has severely limited the extent of use of these techniques to relatively small sintered materials.

Another method reported in the prior art is to infiltrate a molten metal into the sintered material to fill the voids within the sintered body, thereby increasing density. This procedure is quite complex, however, in that it requires an additional processing step, and likewise has not found full industrial acceptance.

SUMMARY OF THE INVENTION

Accordingly, it is one object of this invention to overcome the above-mentioned defects and to provide high density sintered iron base alloys.

Another object of the present invention is to provide a simplified method for producing a sintered iron-base alloy which is characterized by improved density and hardness.

A still further object of this invention is to provide a method for producing a sintered iron-base alloy without the requirement for high pressures either during or subsequent to the sintering process.

A further object of the invention is to provide a method for producing large iron-base sintered alloy articles.

These and other objects have now herein been attained by sintering the alloy component particles within the temperature range at which a solid phase and a liquid phase of the alloy coexist. The liquid phase will infiltrate any voids formed between the solid phase of the alloy and will thereby increase the product density and improve product hardness.

BRIEF DESCRIPTION OF THE DRAWINGS

This invention will be described by reference to certain figures and diagrams in which:

FIG. 1 is an equilibrium diagram of iron-carbon alloys;

FIG. 4 is a perspective, partially cut-away view showing a front hood of an automobile which has been prepared by pressing dies which are produced according to the present invention;

FIG. 5 is a schematic sectional view showing the operations necessary for sintering a particulate material in order to produce a pressing die;

FIG. 6 is a sectional view showing a pressing device having said dies prepared by the methods of this invention; and, FIG. 7 is a photomicrograph (400 X magnification) of an iron-6% carbon sintered alloy which is made by the methods of the present invention.

DETAILED DESCRIPTION OF PREFERRED EMBODIMENTS

Figure 3:
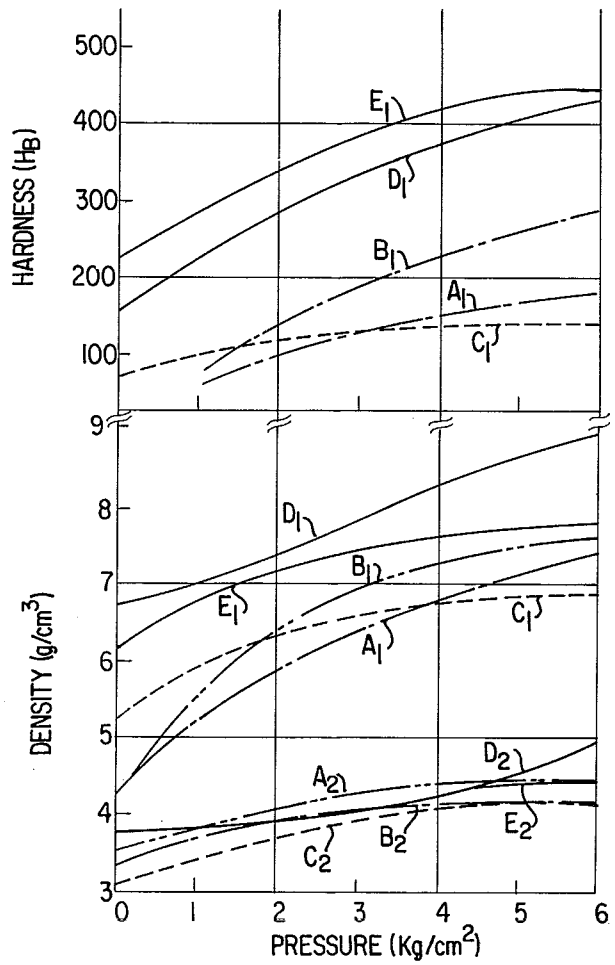
FIG. 3 is a graph showing the relation between the pressure and the density and that between the pressure and the hardness of the sintered material.

This invention relates to a method for producing sintered iron-base alloys characterized by high density which is produced without extraneous pressures or under low pressures.

Suitable starting particulate materials for this invention include particulate or powder mixtures of iron with other alloyable metal, mixed powders of iron and carbon, mixed powders of iron, other metal and carbon, and particulate iron alloy. The mixed iron-base particulate material is packed into a mold, and heated to a sintering temperature in the range at which the solid phase and liquid phase of the alloy consisting of said particulate material coexist. This temperature range will hereinafter be referred to as the "solid-liquid phase temperature range", and is defined as that temperature range in which an alloy, consisting of two or more elements contained in the material powder will coexist in the solid and liquid phases, as shown in an equilibrium diagram of the alloy.

For example, in a well known equilibrium diagram of iron-carbon alloys, which is shown in FIG. 1, the carbon content by weight % is plotted on the abscissa and the temperature (°C.) is plotted on the ordinate. The range of temperatures, relative to carbon content, including the L $+\gamma$ phase and the L $+\delta$ phase (hatched to the left, downwardly and enclosed by rigid lines), is the solid-liquid phase range of the iron-carbon alloys, and is the usable temperature range of the present invention.

Generally speaking, it is known that there is a solid-liquid temperature range for iron-carbon alloys containing more than 4.3% carbon. However, in this case, carbon contained in amounts in excess of 4.3% will float on the surface of the molten iron-carbon alloy in the liquid phase condition, so that it is impossible to obtain a uniform material containing greater than 4.3% carbon. The actual border line between the solid-liquid phase and the liquid phase is therefore not completely clear. However, it was recognized that there is an L + $Fe_3C$ phase, in which a liquid phase and cementite coexist. In FIG. 1, the border line between the liquid phase and the liquid-sold L = $Fe_3C$ phase is shown as a dotted line. The L + $Fe_3C$ phase, i.e., that portion of the graph hatched to the right and downwardly in the right hand of FIG. 1, is also an applicable temperature range in the present invention. A sintered iron-carbon alloy containing more than 4.3% carbon was obtained by sintering the material powders containing the same amount of the carbon as that of the alloy at a temperature higher than the solid phase line T (about 1,147°C.).

It should be appreciated by one of ordinary skill in the art, that the sintering temperatures used in the present invention are quite different from those conventionally employed. The usual sintering temperature ranges employed in the prior art are those temperatures from 800° to 1,120°C., shown by the hatched lines extending downwardly and to the right in the figure. T and U each designate the lower boundaries between the solid and solid-liquid phase range and accordingly, it can be seen that conventional sintering is conducted in the solid phase temperature.

When a particulate mixture of iron (Fe) and 1.5% (by weight) graphite (C) is used, the solid-liquid phase temperature range of Fe-1.5% C alloy formed of the above mixture is from 1,250°C. to 1,420°C. (in FIG. 1). If the particulate mixture is heated to the above-liquid phase temperature range, the following sequence of events seems to occur: the graphite in the mixture is first gradually diffused into the iron; the Fe-1.5% C (by weight) alloy is then formed into a solid phase; and the alloy enters the solid-liquid phase to accomplish the sintering operation.

During sintering, voids in the sintered alloy are filled with the alloy in the liquid phase so that a type of slurry is formed. This enables the formation of the high density sintered body.

In contrast, if the particulate mixture is heated only up to the solid phase temperature, i.e., from 800°C to 1,120°C., as in conventional sintering techniques, an alloy body is formed, but it is characterized by low density and poor hardness.

Even if high pressure is applied during or subsequent to sintering, the voids in the sintered body will not be completely eliminated and the density will still not be as high as the density of the product of the present invention.

The procedure for sintering according to this invention is to place the iron particulate mixture into a mold. The mold and mixture are then brought up to a temperature within the solid-liquid coexistent phase of the iron-base alloy in a heating furnace for the required time period. The heat may be applied after the mold and mixture are placed into the furnace or the mold and mixture may be placed into a preheated furnace.

In the present invention, it is not always required to apply pressure to the particulate mixture during the sintering process. Even without the application of pressure a sintered iron-base alloy can be produced which is characterized by higher density than that obtainable by conventional sintering technique in the solid phase temperature range.

If pressure is applied during the sintering process, under very low pressures of less than 10kg/cm$^2$, a sufficiently high density sintered alloy can be produced. Particularly, under the pressures of more than 1 kg/cm$^2$, a practically usable sintered alloy can be produced which is characterized by high density of more than about 65 percent of the theoretical density thereof. (See FIGS. 3 and Table 4).

When using the present technique, it has been found that, in general, the higher the sintering temperature, the higher will be the density obtained. As the temperature rises, however, the sintering operation becomes more complicated and accordingly, it is preferable to use a sintering temperature in the lower portion of the solid-liquid phase temperature range.

A wide variety of particulate alloyable metals may be admixed with the particulate iron powder, such as graphite powder. For instance, suitable such metals include carbon and one or more metal powders, such as tungsten (W), and molybdenum (Mo), manganese (Mn), chromium (Cr), titanium (Ti), vanadium (V), niobium (Nb), tantalum (Ta), and boron (B) and mixtures thereof. Any of the cast-irons or various steels may be used for the iron component. Moreover, mixtures of various iron alloy powders, carbon or other metal powders can be used.

The mold used in this process should be formed from a ceramic material or alumina, which will not react with the alloy or any of its components and which is capable of enduring the sintering temperatures. The mold need not necessarily have the same shape as the outer surface of the sintered product, but the mold may be of the type used for forming plates or rods.

One of the unique attributes of this invention is that it can even be applied to previously sintered, void-containing, iron-base alloys simply by re-sintering within the solid-liquid phase temperature range. Re-sintering by this method will result in an alloy of improved high density.

Having generally described the invention, a further understanding can be obtained by reference to certain specific Examples, which are included herein for purposes of illustration only and are not limiting unless otherwise indicated.

EXAMPLE 1

Particulate mixtures A to E were treated by the methods of this invention as specified in Table I. These mixtures were packed into containers made of alumina and heated in an electric heating furnace made of graphite. A predetermined pressure was applied to the mixture in the container by a punch made of alumina and a weight made of iron. The mold with the contained mixture was then placed into a furnace at a temperature of about 600°C., and heat was applied so that the temperature was increased at a rate of 45°C. per minute until the predetermined sintering temperature in the solid-liquid phase temperature range of the alloy consisting of particulate mixutre was reached. The temperature was held at this point for about 10 minutes. After this process, the furnace was cooled to about 1,000°C. at the rate of about 15°C. per minute and the container was thereafter removed and cooled in air.

With samples A to E, shown in Table 1, an electrolytic particulate iron was used as the iron source. Particulate graphite was used as the carbon source, Fe-81% (by weight) W alloy particles for the tungsten source, Fe-62% (by weight) Mo alloy particles for the molybdenum source, and an atomized powder of high speed steel (Fe-0.8% C-6% W-5% Mo-4% Cr-1.8% V (by weight)) was used for sample F. The particular size was from −100 to −200 mesh. Pressure was applied and the sintering temperature, density (g/cm$^3$) and Brinell hardness ($H_B$) of the product was measured as is shown in Table 2. For comparison purposes, the density of the same sintered body, produced by conventional sintering in the solid phase temperature range, is shown and the theoretical density of each composition is shown.

TABLE 1

| Samples | Composition of Particulate Mixture (by weight) | Solid-Liquid Temperature Range (about) |
|---|---|---|
| A | Fe-1.5%C | 1,250 to 1,420 (°C) |
| B | Fe-2%C | 1,149 to 1,390 |
| C | Fe-6%C | 1,147 to unknown |
| D | Fe-20%W-1.2%C | 1,140 to 1,400 |
| E | Fe-10%Mo-2%C | 1,080 to 1,370 |
| F | High Speed Steel | 1,280 to 1,470 |

TABLE 2

| Samples | Pressure (kg/cm$^2$) | Solid-liquid Phase Sintering | | | Solid Phase Sintering | | Theoretical Density (g/cm$^3$.) |
|---|---|---|---|---|---|---|---|
| | | Temp. (°C.) | Density (g/cm$^3$) | Hardness ($H_B$) | Temp. (°C.) | Density (g/cm$^3$.) | |
| A | 5.5 | 1,350 | 7.2 | 175 | 1,200 | 4.5 | 7.79 |
| B | 3.1 | 1,200 | 6.8 | 185 | 1,100 | 4.3 | 7.76 |
| C | 3.1 | 1,200 | 6.6 | 125 | 1,100 | 4.0 | 7.53 |
| D | 4.4 | 1,350 | 8.5 | 390 | 1,100 | 4.3 | 10.09 |
| E | 4.4 | 1,300 | 7.7 | 430 | 1,000 | 4.3 | 7.99 |
| F | 4.4 | 1,300 | 6.5 | — | 1,200 | 3.6 | 8.37 |

The density was measured by Archimede's principle, and the Brinell hardness of each of the samples A, B, and C was measured with the sintered material obtained under said sintering condition. Density and hardness of samples D, E and F were measured with the sintered materials, which were annealed at 600°C. and quenched at 1,000°C. The sintered materials, sintered at a solid phase temperature as in conventional methods, were very porous and too brittle to be measured by the Brinell hardness tester, and therefore no Brinell hardness measurements are shown.

In order to investigate the relationship between the sintering temperature and density, and that between the sintering temperature and hardness, under constant pressure, samples A to E were sintered at temperatures of between 1,100°C. and 1,350°C., within the solid-liquid phase temperature range under the respective pressures indicated in Table 2.

Figure 2:
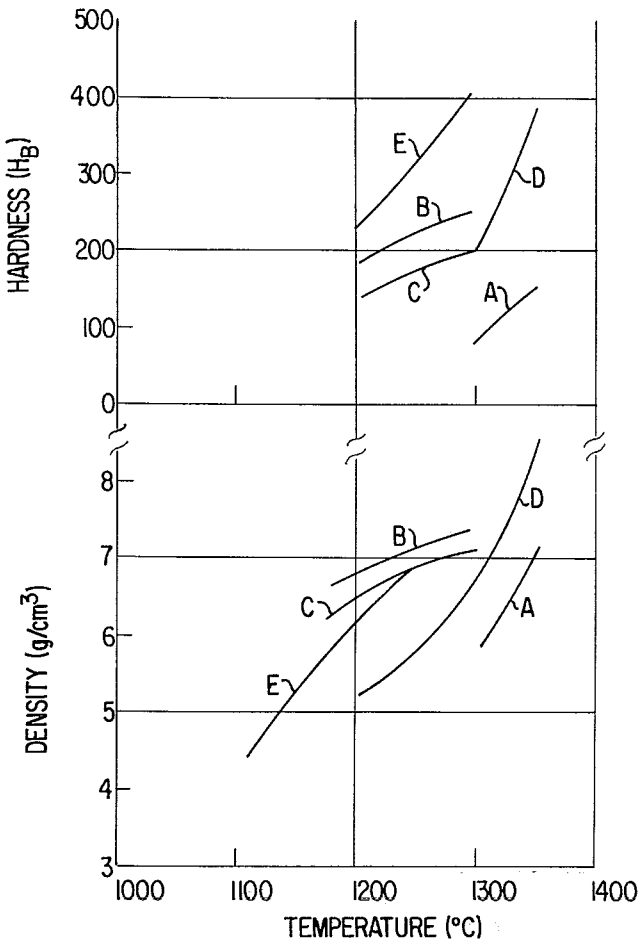
FIG. 2 is a graph showing the relation between the sintering temperature and the density and that between the sintering temperature and the hardness of the sintered material.

The density and hardness of the sintered materials obtained are shown in FIG. 2. In FIG. 2, the abscissa represents sintering temperature and the ordinate represents density (g/cm$^3$) and hardness ($H_B$). The symbols A to E of the lines correspond to samples having the symbols A to E, shown in Table 1.

As can be seen from FIG. 2, sample (line) A shows a density of 5.8 g/cm$^3$ at the sintering temperature of 1,300°C. The density increases to 7.2 g/cm$^3$ when the temperature increases to 1,350°C. Sample D shows a density of 5.2 g/cm$^3$ at a sintering temperature of 1,200°C. When the temperature is increased to 1,350°C., the density increases to 8.5 g/cm$^3$. The samples B, C and E exhibit the same results as samples A and D, i.e., when the sintering temperature increases, the density increases. With respect to the hardness of the sintered materials, as the sintering temperature increases, the hardness increases. Sample A exhibited a hardness of 90 $H_B$ at 1,300°C., 150 $H_B$ at 1,350°C. Sample D exhibited a hardness of 210 $H_B$ at 1,300°C., and 400 $H_B$ at 1,350°C. The other samples exhibited similar properties as samples A and D.

Samples A, B, C, D, and E were sintered at the temperature shown in Table 3 under pressures ranging from 0 to 6 kg/cm$^2$.

In FIG. 3, the abscissa represents pressure (kg/cm$^2$) and the ordinate represents density and hardness. The symbols $A_1$ to $E_1$ and $A_2$ to $E_2$ represent the corresponding samples and the respective sintering temperatures illustrated in Table 3.

TABLE 3

| Sample | Sintering Temperature (°C.) | | Symbol in FIG. 3 |
|---|---|---|---|
| A | 1,350 | (S + L) | $A_1$ |
| | 1,200 | (S) | $A_2$ |
| B | 1,200 | (S + L) | $B_1$ |
| | 1,100 | (S) | $B_2$ |
| C | 1,200 | (S + L) | $C_1$ |
| | 1,100 | (S) | $C_2$ |
| D | 1,350 | (S + L) | $D_1$ |
| | 1,100 | (S) | $D_2$ |
| E | 1,300 | (S + L) | $E_1$ |
| | 1,000 | (S) | $E_2$ |

In Table 3, S + L indicates that the sintering temperature is in the solid-liquid phase range, and S indicates that the sintering temperature is in the solid phase range.

In FIG. 3, it can be seen that sample ($A_2$) which was sintered in the solid phase shows a density of 3.5 g/cm$^3$. If 6 kg/cm$^2$ pressure is added during sintering, the density increases only to 4.5 g/cm$^3$. On the other hand, alloy ($A_1$) sintered without pressure in the solid-liquid phase exhibited a density of 4.3 g/cm$^3$. The density increased to 7.4 g/cm$^3$ by sintering with 6 kg/cm$^2$ pressure. With sample ($D_2$) sintered without pressure in the solid phase, a density of 3.7 g/cm$^3$ was obtained. The density increased to 5 g/cm$^3$ when sintering occurred under a pressure of 6 kg/cm$^2$. On the other hand, alloy ($D_1$) sintered without pressure in the solid-liquid phase showed a density of 6.7 g/cm$^3$, which is about 1.3 times the value of ($D_2$) sintered under 6 kg/cm$^2$ pressure in the solid phase, Furthermore, ($D_1$) attained a density of 9.0 g/cm$^3$ by sintering under 6 kg/cm$^2$ pressure. The other samples showed similar properties, i.e., the density of the material sintered in the solid-liquid phase range was from 1.3 to 2 times that of the same material sintered in the solid phase.

With respect to the hardness of the sintered materials, those sintered in the solid phase were porous and brittle, so that their value could not be measured. In the case of materials sintered in the solid-liquid phase, the hardness of the alloy ($A_1$) was 90 $H_B$ when sintered under a pressure of 2 kg/cm². The hardness increased to 160 when sintered under a pressure 6 kg/cm². The alloy ($D_1$) showed a hardness of 150 $H_B$ when sintered without pressure, and attained 430 $H_B$, almost 200% increase when sintered under a pressure of 6 kg/cm². The other samples showed similar results, i.e., as the pressure increased, the hardness increased.

In Tables 4 and 5, the obtained density of each sample which was sintered in the solid-liquid phase temperature range and in the solid phase temperature range under pressures of 1, 2 and 6 kg/cm² are shown. In addition to above values, the theoretical density of each sample and the ratio of each obtained density of each sample to said theoretical density (X in Tables 4 and 5) are also shown.

TABLE 4

| Symbol in FIG. 3 | Pressure 1 kg/cm² density (g/cm³) | X (%) | 2 kg/cm² density (g/cm³) | X (%) | 6 kg/cm² density (g/cm³) | X (%) | Theoretical Density (g/cm³) |
|---|---|---|---|---|---|---|---|
| $A_1$ | 5.2 | 66.8 | 5.9 | 75.7 | 7.5 | 96.1 | 7.79 |
| $B_1$ | 5.5 | 71.0 | 6.5 | 83.7 | 7.7 | 99.0 | 7.76 |
| $C_1$ | 5.9 | 78.2 | 6.4 | 85.0 | 6.9 | 91.5 | 7.53 |
| $D_1$ | 7.0 | 69.5 | 7.4 | 73.5 | 9.0 | 89.5 | 10.09 |
| $E_1$ | 6.7 | 83.8 | 7.2 | 90 | 7.8 | 97.5 | 7.99 |

$$X = \frac{\text{Density of sintered alloy}}{\text{Theoretical density}} \times 100\ (\%)$$

Table 5

| Symbol in FIG. 3 | Pressure 1 kg/cm² density (g/cm³) | X (%) | 2 kg/cm² density (g/cm³) | X (%) | 6 kg/cm² density (g/cm³) | X (%) | Theoretical Density (g/cm³) |
|---|---|---|---|---|---|---|---|
| $A_2$ | 3.8 | 48.5 | 4.1 | 52.3 | 4.5 | 57.5 | 7.79 |
| $B_2$ | 3.7 | 47.7 | 3.9 | 50.3 | 4.2 | 54.2 | 7.76 |
| $C_2$ | 3.4 | 45.1 | 3.6 | 47.8 | 4.2 | 55.7 | 7.53 |
| $D_2$ | 3.8 | 37.8 | 3.9 | 38.8 | 4.9 | 48.6 | 10.09 |
| $E_2$ | 3.6 | 45.0 | 3.9 | 48.8 | 4.5 | 56.3 | 7.99 |

$$X = \frac{\text{Density of sintered alloy}}{\text{Theoretical density}} \times 100\ (\%)$$

As apparent from Table 4 and 5, if each sample is sintered in the solid-liquid phase temperature range, even under a pressure as low as 6 kg/cm² the sintered alloy characterized by high density of more than about 90° of the theoretical density, can be produced. And also under only a pressure of 2 kg/cm², high density of more than about 70% can be obtained. Therefore, if the solid-liquid phase sintering is performed under pressures from 2 kg/cm² to 6 kg/cm², the product of sufficiently good quality can be obtained.

In contrast, in the sample $A_2 - E_2$ which are sintered in the solid phase temperature range, even if a pressure of 6 kg/cm² is applied during sintering, only the density as low as less than 58% of the theoretical density can be obtained.

As can be seen from the results of the Examples (Table 2, FIGS. 2 and 3), when the method of the present invention is used, sintered iron-base alloys having high density and hardness can be obtained as compared with the same alloy obtained by the conventional sintering techniques, i.e., sintering in the solid phase temperature region.

FIG. 7 is a photomicrograph (400 X magnification) of the sintered metal structure of sample C (Fe – 6%C). As can be seen from the photograph, the structure is different from a mixture of graphite and iron, and it all became to be flaky graphite (in the photograph, black fibrous parts). There are no voids as is usually seen in sintered materials made by conventional methods. By analyzing this sintered material, it was recognized that the sintered material was an alloy which had the composition of Fe–6%C. What is quite unique is that by conventional molten metal methods, it would have been impossible to produce an iron alloy having such a high carbon content (more than about 4.3% because a dross is produced and the carbon is isolated from the alloy. In contradistinction, the method of the present invention can produce iron alloys containing as much as 6% or even higher of carbon.

Figure 4:
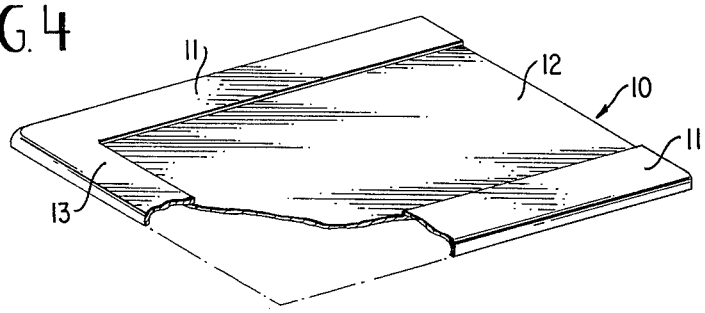
FIGS. 4, 5, and 6 are views showing apparatus used in the present invention.
Figure 5:
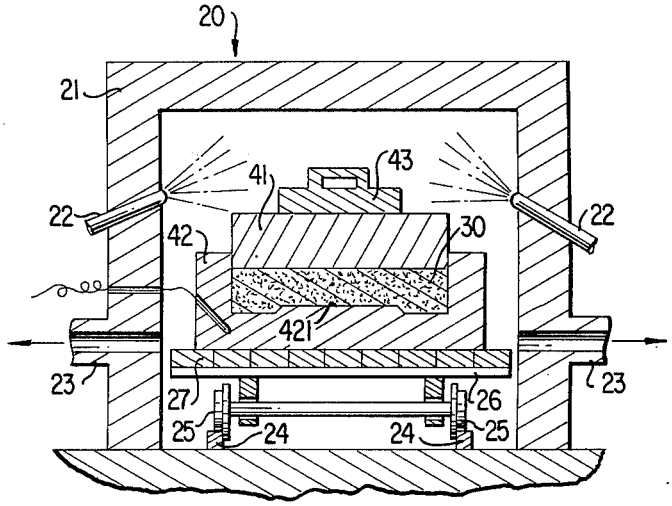
Figure 6:
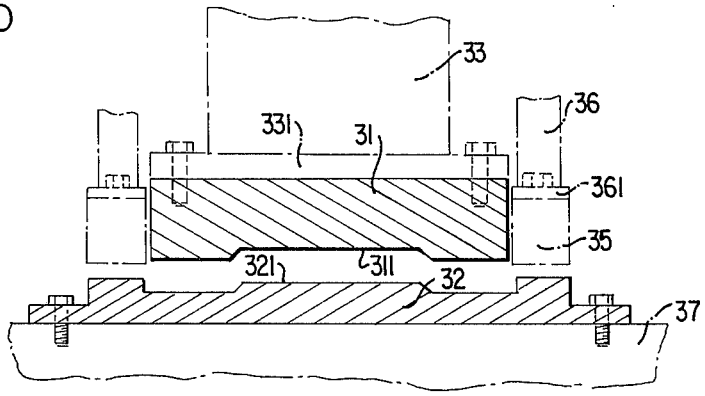

The methods of this invention were used for producing pressing dies to form front hoods for automobiles. FIGS. 4, 5 and 6 show this embodiment. The size of the hood 10 formed by these dies is about 1.2 meters in width and about 1.1 meters in length. As can be seen in FIG. 4, the top end portion 13 of the hood 10 bends downwardly, and the central portion 12 is made to be a small dent as compared with the top end portion 13 and the end portions 11. The lower surface of the hood is formed by the upper die 31 of a pressing device (in FIG. 6), and the upper surface of the hood is formed by the lower pressing die 32.

In order to produce an upper pressing die 31, as shown in FIG. 5, a material powder composed of iron powder (88% by weight) graphite powder (2% by weight) and molybdenum powder (10% by weight) is packed into a ceramic mold 42 for sintering. The mold is mounted on a heat-resistant steel truck 26. Then the mold 42 containing the powders and the truck 26 is introduced into a heating furnace made of fireproof materials and heated to about 1,250°C.

In detail, the mold 42 has a mold surface 421 which is the same as that of the upper mold 31. After packing the material powder 30 into the mold 42, a ceramic plate 41, which has almost the same shape as the shape as the shape formed by the inner side wall of the mold 42, is mounted onto the powder 30 in the mold 42. An iron weight 43 is mounted onto the ceramic plate 41 in order to press the powder 30.

The truck 26 has wheels 25 at its lower portions and the wheels are arranged so that the truck can move into, and out of the furnace 20 along rails 24. In sintering, the mold 42 is provided on the truck 26 through the fire bricks 27 and the truck in introduced into the furnace 20. In the furnace 20, as shown in FIG. 5, gas burners 22 are disposed on thhe upper sides of the side walls of the furnace 20. Exhaust pipes 23 are connected to the lower sides of said walls, slightly above the height of the truck. The furnace 20 is heated by a jet of flames from burners 22, and the temperature within the furnace 20 is measured by a thermocouple 45, disposed at the side wall of the mold 42. At the same time, the strength of the flame from the burners 22 is automatically controlled so that the material powder 30 is kept at a sintering temperature of about 1,200°C.

The material powder 30 in mold 42 is heated to 1,200°C. in the solid-liquid phase temperature range and kept within that range for about 20 minutes under a pressure of about 2 kg/cm$^2$. Pressure is applied by weight 43. After cooling in furnace 20, the truck 26 is removed from the furnace, and the resulting sintered upper die 31 is removed from the mold 42. The sintered die 31 is again heated to about 1,000°C. for quenching and annealed at about 600°C. Following this treatment, as shown in FIG. 6, the die 31 is fixed by bolts at the top portion 331 of pressing apparatus 33 so as to oppose against the lower die 32 which is produced in the same way as die 31.

The lower die 32 and blank holders 36 are respectively fixed on pressing table 37 and the top end portions 361 of the pressing apparatus, with bolts.

The upper die 31 obtained by the process described above had a density of about 7.0 g/cm$^3$ and a hardness of 270 $H_B$.

The hood 10 was formed by pressing a mild steel plate, using pressing dies 31 and 32. Die 31 was shown to be equally as good as conventional pressing dies made of molten material and could be used repeatedly over an extended period of time.

This embodiment showed that a large, strong pressing mold could be obtained using pressures as low as 2 kg/cm$^2$ according to this invention. On the other hand, if the die is produced by conventional sintering methods, very large and powerful pressing equipment must be used to obtain even comparable results, but even then, it is difficult to obtain dies of equally high density, even if the pressure is increased.

Having now fully described the invention, it will be apparent to one of ordinary skill in the art that many changes and modifications can be made without departing from the spirit or scope of the invention. Accordingly,

What is claimed as new and intended to be covered by letters patent is:

1. A method for producing a sintered product of iron-base alloy having a high density and high hardness consisting essentially of:

placing a mixture of a particulate material selected from the group consisting of mixed particles of iron and carbon, mixed particles of iron and other metal, mixed particles of iron, other metal and carbon, and particles of an iron-base alloy in a suitable mold, wherein said other metal is selected from the group consisting of manganese, tungsten, molybdenum, chromium, vanadium, niobium and tantalum, heating said mixture to a temperature such that an alloy consisting of said particulate mixture will form a coexistent liquid and solid phase, maintaining said temperature for a period sufficient to cause sintering, cooling said sintered product in said mold, and thereafter removing said product in solid phase from the mold.

2. The method of claim 1, wherein said mold is formed from a ceramic material.

3. The method of claim 1, wherein said carbon is in the form of graphite.

4. The method of claim 1, wherein said particulate material contains from 1.5 to 6% carbon by weight.

5. The method of claim 1, wherein said particles of iron-base alloy is steel.

6. The method of claim 5, wherein said steel is selected from the group consisting of carbon steel and high speed steel.

7. The method of claim 1, wherein said particulate material is a particulate mixture of iron, carbon and carbon steel, and wherein said particulate mixture is sintered at a temperature in the range in which iron-carbon alloys are in the $L + \gamma$ phase, $L + \delta$ phase, or in the $L + Fe_3C$ phase.

* * * * *